United States Patent [19]

Pilz

[11] 4,119,197

[45] Oct. 10, 1978

[54] APPAREL HANGING RECEIVING ELEMENT

[75] Inventor: William M. Pilz, Eldridge, Iowa

[73] Assignee: Container Corporation of America, Chicago, Ill.

[21] Appl. No.: 849,013

[22] Filed: Nov. 7, 1977

[51] Int. Cl.[2] ..... B65D 85/18

[52] U.S. Cl. ..... 206/279; 206/289

[58] Field of Search ..... 206/279, 284, 289, 290, 206/291, 292, 360

[56] References Cited

U.S. PATENT DOCUMENTS

| | | | |
|---|---|---|---|
| 1,287,111 | 12/1918 | Roth | 206/290 |
| 2,796,977 | 6/1957 | Dinine | 206/291 |
| 2,827,160 | 3/1958 | Richer | 206/291 |
| 3,057,460 | 10/1962 | Richer | 206/289 |
| 3,057,482 | 10/1962 | Richer | 206/279 |

*Primary Examiner*—Herbert F. Ross

*Attorney, Agent, or Firm*—Carpenter & Ostis

[57] ABSTRACT

A separate apparel hanger receiving element removably engages certain wall of an outer shipping container to retain a hook portion of an apparel hanger.

1 Claim, 5 Drawing Figures

APPAREL HANGING RECEIVING ELEMENT

BACKGROUND OF THE INVENTION

1. Field of the Invention

This invention relates to shipping containers for apparel and, more particularly, to shipping containers having separate apparel hanger receiving elements.

2. The Prior Art

The apparel packaging industry does not have an effective way of packaging apparel positioned on hangers and retaining same in undisturbed condition during shipment.

The present invention teaches very economical and effective means of retaining a proper position of apparel placed on hangers, such as are commonly used for hanging of coats and the like.

SUMMARY OF THE INVENTION

A separate apparel hanger receiving element is placed in a shipping container. Certain panels of the element are inserted through slots formed in container to releasably retain the element within the container. The element is formed with an opening for receiving a hook portion of an apparel hanger.

DRAWING

SPECIFICATION

Figure 1:
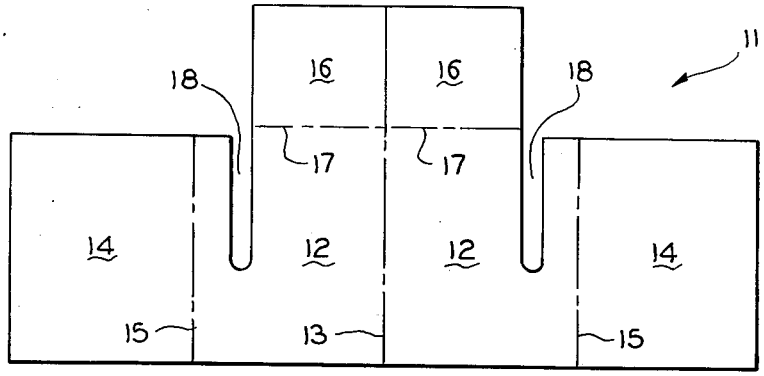
FIG. 1 is a plan view of a blank from which a hanger receiving element may be formed.

Referring now to the drawing, there is shown an apparel hanger receiving element, generally designated 10, formed from a properly scored and cut blank 11 of paperboard, or the like.

The element 10 has a pair of inner panels 12 hingedly connected to each other along a hinge line 13.

A pair of outer panels 14 are hingedly attached to their respective adjacent inner panel 12 by a hinge line 15.

Each inner panel 12 has an extension 16 extending from an edge thereof and being foldably joined to the inner panel by a hinge line 17.

Figure 2:
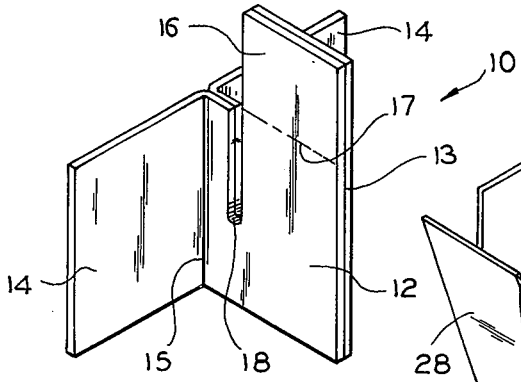
FIG. 2 is a perspective view of a hanger receiving element in a partially folded condition.
Figure 3:
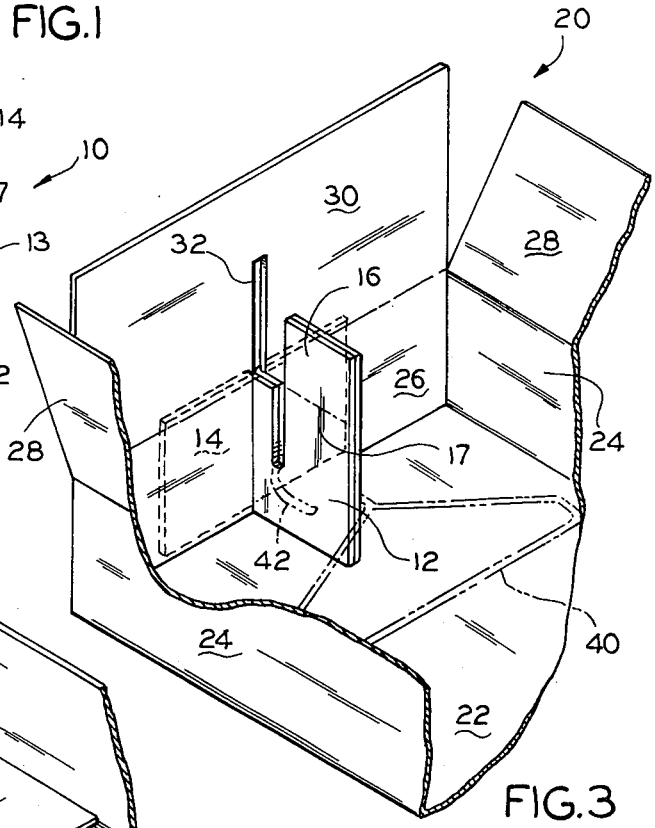
FIG. 3 is a perspective fragmentary view of a hanger receiving element partially inserted into a shipping container.
Figure 5:
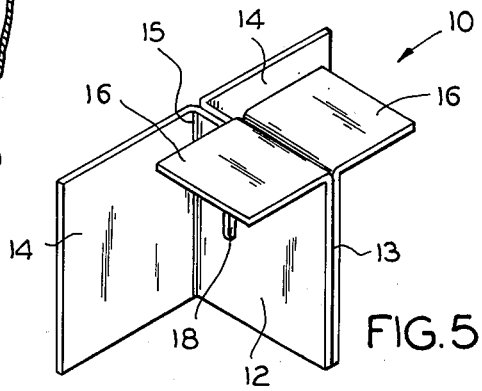
FIG. 5 is a perspective view similar to FIG. 2 but illustrating the element in a folded condition as it appears when secured in the container.

An opening 18 is formed in each inner panel 12. When the inner panels are folded into a face-to-face relationship, as shown in FIGS. 2, 3 and 5, the opening 18 in one inner panel is in registry with the opening in the other inner panel. As it will be described in more detail later, the opening 18 receives a portion of an apparel hanger.

Figure 4:
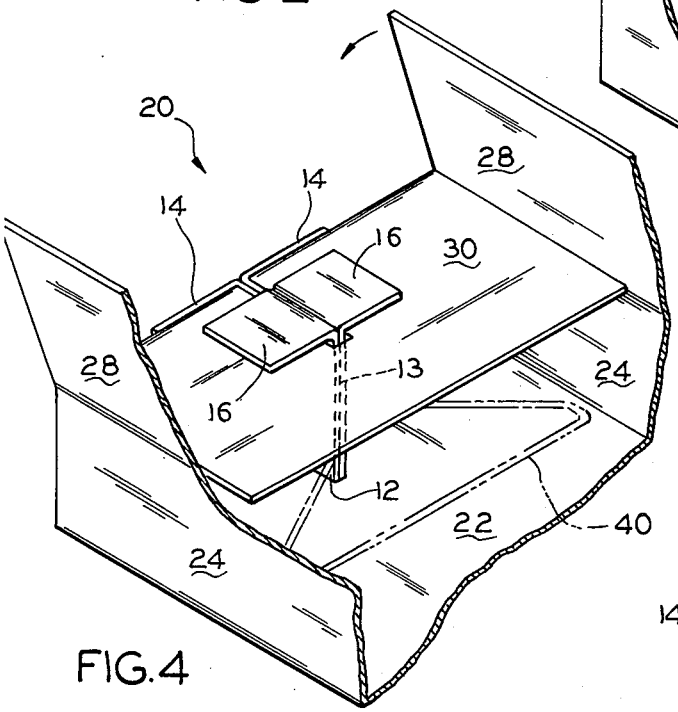
FIG. 4 is a perspective fragmentary view similar to FIG. 3 but showing the element secured in the container.

Referring now to FIGS. 3 and 4, there is shown a shipping container 20 formed from a blank of paperboard, or the like.

The container has a bottom wall 22, a pair of side walls 24, ends walls 26 (only one shown), and a top wall formed from a pair of panels 28.

An inner closure flap 30 is hingedly connected to an edge of the end wall 26 and is folded downwardly and inwardly into the container to underlie portions of the top wall panels 28.

A continuous slot 32 is formed in the end wall 26 and the closure flap 32 to receive portions of the element 10 when the same is inserted into the container.

A partially folded element 10 is placed in the container in such a manner that the outer panels 14 are received through the slot 32 formed in the end wall 26 and extend outwardly of the container. After the panels have been inserted through the slot 32, they are folded to lie flat against an outer surface of the end wall 26.

Likewise, extensions 16 are received through the remaining portion of the slot 32 and, once inserted through the slot, are folded outwardly to contact an outer surface of the inner closure flap 30.

Thus it can be seen that folding of the panels 14 and extensions 16 secures the element 10 in the container 20.

An apparel hanger 40 having a hook portion 42 is placed in the container with the hook portion 42 being received through the opening 18 in the inner panels 12. Apparel can be placed on the hanger, the hanger remaining secured in place during shipment by engagement of the hook portion 42 with the element 10.

I claim:

1. In combination, a shipping container having integrally formed bottom, side, top and end walls, a closure flap hinged to an edge of at least one of said walls, a continuous slot formed in an end wall and extending only into said flap hinged to said end wall, and a separate apparel hanger receiving element releasably retained in said container and formed from a cut and scored blank of paperboard, or the like, said element including:

(a) a pair of inner and a pair of outer panels hingedly connected in alternating sequence along parallel hinge lines;

(b) said inner panels being folded against each other into a face-to-face relationship along one of said parallel hinge lines;

(c) each of said inner panels having a top extension hinged to an edge thereof and received through said slot formed in said closure flap of said container;

(d) said extensions being folded into contacting relationship with the exterior surface of said closure flap;

(e) said outer panels being received through said slot in said end wall of said container and folded into contacting relationship with the exterior surface of said end wall;

(f) an opening formed in said inner panels inwardly of said hinge lines connecting said inner panels with their respective adjacent outer panels and being adapted to receive a hook portion of said hanger.

* * * * *